US007743956B2

(12) United States Patent
Yagi et al.

(10) Patent No.: US 7,743,956 B2
(45) Date of Patent: Jun. 29, 2010

(54) TAPE LOCKING MECHANISM FOR MOTOR-DRIVEN STAPLERS

(75) Inventors: Nobuaki Yagi, Tokyo (JP); Katsunori Manabe, Tokyo (JP); Kiichi Haramiishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 562 days.

(21) Appl. No.: 10/519,194

(22) PCT Filed: Jun. 23, 2003

(86) PCT No.: PCT/JP03/07931

§ 371 (c)(1),
(2), (4) Date: Dec. 22, 2004

(87) PCT Pub. No.: WO04/000515

PCT Pub. Date: Dec. 31, 2003

(65) Prior Publication Data

US 2005/0284911 A1 Dec. 29, 2005

(30) Foreign Application Priority Data

Jun. 24, 2002 (JP) ..... 2002-183364

(51) Int. Cl.
*B25C 1/06* (2006.01)

(52) U.S. Cl. ..... 227/131; 227/120; 227/134; 227/155

(58) Field of Classification Search ..... 227/120, 227/131, 134, 155
See application file for complete search history.

(56) References Cited

U.S. PATENT DOCUMENTS 4,199,095 A * 4/1980 Yamanoi ..... 227/125
4,344,554 A * 8/1982 Cross ..... 227/30
5,009,355 A * 4/1991 Akizawa et al. ..... 227/114
5,346,114 A * 9/1994 Udagawa et al. ..... 227/120
5,460,313 A * 10/1995 Magnusson et al. ..... 227/131
5,702,047 A * 12/1997 Yoshie ..... 227/131
5,836,502 A * 11/1998 Kanai et al. ..... 227/131
5,862,971 A * 1/1999 Ebner ..... 227/155
5,975,396 A * 11/1999 Manabe ..... 227/2
6,050,471 A * 4/2000 Yagi ..... 227/119
6,568,579 B2 * 5/2003 Mochizuki ..... 227/131
6,626,348 B2 * 9/2003 Kitamura ..... 227/155
6,634,536 B2 * 10/2003 Yoshie ..... 227/131
6,736,304 B2 * 5/2004 Mochizuki ..... 227/131
6,902,094 B2 * 6/2005 Mochizuki et al. ..... 227/155
6,918,524 B1 * 7/2005 Mochizuki et al. ..... 227/113

(Continued)

FOREIGN PATENT DOCUMENTS

EP 1 066 934 1/2001

(Continued)

*Primary Examiner*—Rinaldi I. Rada
*Assistant Examiner*—Michelle Lopez
(74) *Attorney, Agent, or Firm*—Morgan, Lewis & Bockius LLP

(57) ABSTRACT

A table including a clincher mechanism is provided to be supported pivotably by a rear portion of a main body frame, the table is integrally formed with a wing piece 9 projected along the main body frame, a locking device is formed between the wing piece of the table and the main body frame, and by engaging the locking device with the wing piece, a pivoting force in an opening direction of the table is hampered.

2 Claims, 11 Drawing Sheets

U.S. PATENT DOCUMENTS

| | | | | |
|---|---|---|---|---|
| 6,948,224 | B2 * | 9/2005 | Coombs et al. | 29/407.01 |
| 7,014,091 | B2 * | 3/2006 | Mochizuki | 227/155 |
| 2006/0213951 | A1 * | 9/2006 | Yagi | 227/155 |
| 2007/0246504 | A1 * | 10/2007 | Kanai | 227/155 |

FOREIGN PATENT DOCUMENTS

| | | |
|---|---|---|
| EP | 1 112 824 A2 | 7/2001 |
| EP | 1 166 981 | 1/2002 |

* cited by examiner

TAPE LOCKING MECHANISM FOR MOTOR-DRIVEN STAPLERS

TECHNICAL FIELD

The present invention relates to a lock mechanism of a table of an electric stapler for striking out a staple formed in a C-shape from a magazine portion, penetrating a sheets of paper to be bound pinched between the magazine portion and a clincher portion arranged to be opposed thereto, and folding to bend a leg portion of the staple by the clincher portion to bind the sheets of paper to be bound.

BACKGROUND ART

As shown by FIG. 10 and FIG. 11, generally, an electric stapler of this kind is constituted by a cartridge 32 charged with a number of staples and attachable to and detachable from a magazine portion 31 of a main body case 30, a driver mechanism 33 for striking out the staple at inside of the cartridge 32 from the magazine portion 31 by being driven by a motor provided at inside of the main body case 30, and a table 35 arranged to be opposed to a portion 34 for striking out the staple by the driver mechanism 33 and pivotably supported by a side plate constituting the main body frame 30 for striking out the staple charged in the magazine portion 31 to sheets of paper P to be bound arranged between the magazine portion 31 and the table 35 from the magazine portion 31 by driving the driver mechanism 33 by driving the motor and folding to bend a front end of a leg of the staple penetrated through the sheets of paper to be bound by a clincher 36 arranged on the table 35.

Normally, the table 35 is arranged to be remote from the staple striking portion 34 of the magazine portion 31 and is operated to pivot to pinch the sheets of paper P to be bound between the table 35 and an upper face of the magazine portion 31 before inserting the sheets of paper to be bound and striking out the staple by the driver mechanism 33. Although the table 35 needs to support a lower face side of the sheets of paper to be bound against a binding load generated during a time period in which the leg of the staple struck out from the magazine portion 31 by the driver mechanism 33 penetrates the sheets of paper to be bound and is folded to bend along a rear face of the sheets of paper to be bound by the clincher 36 formed at a front end portion of the table 35, since an operating stroke of the table 35 is varied in accordance with a thickness of the sheets of paper to be bound, the table 35 cannot directly be driven to pivot by a cam, a link mechanism or the like, and the table 35 is operated by interposing a spring force at the cam or the link mechanism. However, in order to support the binding load which normally becomes about 8 through 10 Kg, a spring of a large load is needed, and a drive mechanism for driving the table 35 by way of the large spring load is enlarged to constitute a factor of hampering small-sized formation of the electric stapler for being included in a copier or the like.

Hence, as shown by FIG. 10 and FIG. 11, there is disclosed a lock mechanism of the table for fixing the table 35 at a closing position by a wedge member fitted to a portion of the table 35 operated by a spring urge force in a direction of pinching the sheets of paper P to be bound in JP-A-2001-191265 or the like. The lock mechanism of the table is constituted by the table 35 a rear end portion of which is pivotably supported by a pivotal support shaft 38 and urged in the closing direction by a torsional coil spring 39, an operating link 40 for holding the table 35 at an opening position, and a wedge member 37 engaged with the table 35 for hampering the table 35 from being pivoted in the opening direction.

Normally, before operating the electric stapler, a support portion 41 formed at the operating link 40 is engaged with a fixed shaft 42 integrally pivoted with the table 35 to hold the table 35 at the opening position, and when the sheets of paper P to be bound is mounted on an upper face of the magazine portion and the electric stapler is operated, engagement of the support portion 41 and the fixed shaft 42 is released by operating the operating link 40 in cooperation with the driver mechanism 33 for striking out the staple to operate the table 35 in a binding direction by the torsional coil spring 39 to pinch the sheets of paper P to be bound arranged between the table 35 and the magazine portion 31. In accordance with operation of the table 35, the wedge member 37 is slid to move by the spring force to engage a locking portion 43 formed at the wedge member 37 with the fixed shaft 42 pivoted integrally with the table 35 to thereby hamper the table 35 from being pivoted in the opening direction to lock at the closing position.

According to the above-described mechanism, the wedge member 37 is slidably held by the main body case 30, the wedge member 37 is slid to move by the spring urge force to engage with the fixed shaft 42 integral with the table 35 to lock the table 35 at the closing position and therefore, no problem is posed since when a range of varying the thickness of the sheets is small, a range of varying a pivotal stroke of the table 35 is comparatively small. However, in the case that a maximum number of sheets for an electric stapler to bind the sheets of paper P is large, the range of the operating stroke of the table 35 is increased, a distance of sliding to move the wedge member 37 is obliged to set to be large, and small-sized formation of the electric stapler cannot be achieved. Further, the wedge member is engaged with the fixed shaft 42 arranged at a vicinity of the pivotal support shaft 38 pivotably supporting the table 35 and therefore, although the wedge member can be adopted in a small-sized stapler which does not produce a large binding load, locking cannot sufficiently be carried out for a large-sized stapler generating a large binding load at a front end side of the table 35.

DISCLOSURE OF THE INVENTION

It is a problem of the invention to resolve a drawback of the above-described background art and to provide a lock mechanism of a table capable of achieving small-sized formation of an electric stapler without being slid to move considerably as in a wedge member even when a pivoting stroke of the table is considerably varied in accordance with a variation in a number of sheets of papers for binding and capable of firmly locking the table by withstanding a binding load of a staple in a state of pinching the sheets of papers to be bound.

In order to resolve the above-described problem, a lock mechanism of a table of an electric stapler according to the invention is characterized in that in an electric stapler in which inside of a main body frame is formed with a magazine portion for containing a number of staples and a staple striking portion for striking out a staple charged in the magazine portion from the magazine portion to sheets of paper to be bound by a driver driven by a motor, and a clincher mechanism for folding to bend a leg portion of the staple penetrated through the sheets along a rear face of the sheets is provided to be carried by a table, the table carrying the clincher mechanism is pivotably supported by a rear portion of a main body frame, the table is integrally formed with a wing piece projected along a side face of the main body frame, locking means is formed between the wing piece of the table and the main body frame, and by engaging the locking means with the wing piece, a pivoting force in an opening direction of the table is hampered.

Further, the locking means is characterized in being constituted by a lock plate including a locking pin engageable with a front end edge of the wing piece at one end thereof and pivotably supported by the main body frame at other end side thereof remote from the locking pin, and when the table is pivoted in an opening direction, the locking pin is engaged with the end edge of the wing piece to hamper the wing piece from being pivoted.

Further, the locking means is characterized in being constituted by an eccentric cam rotatably supported by the main body frame and engageable with the front end edge of the wing piece, and when the table is pivoted in the opening direction, the eccentric cam is engaged with the end edge of the wing piece to hamper the wing piece from being pivoted.

Further, the locking means is characterized in being constituted by engaging teeth in a saw tooth-like shape formed at the front end edge of the wing piece and a locking piece formed with locking teeth engaged with the engaging teeth, the locking piece is constituted to be slidably supported by the main body frame in directions of being brought into contact and separated from the wing piece and urged in a direction of engaging the locking teeth of the locking piece with the engaging teeth of the wing piece, and when the table is pivoted in the opening direction, the locking teeth of the locking piece are engaged with the engaging teeth of the wing piece to hamper the wing piece from being pivoted in the opening direction.

Further, an electric stapler in which inside of a main body frame is formed with a magazine portion for containing a number of staples, and a staple striking portion for striking out a staple charged in the magazine portion from the magazine portion to sheets of paper to be bound by a driver driven by a motor, and a clincher mechanism for folding to bend a leg portion of the staple penetrated through the sheets of paper to be bound along a rear face of the sheets of paper to be bound is provided, is characterized in that a table carrying the clincher mechanism is provided to be pivotably supported by a rear portion of the main body frame, a rotating cam engageable with an upper end face of the table is provided, and by engaging a cam face which is formed at a lower face of the rotating cam and a height of which is gradually changed in a circumferential direction with the upper end face of the table, the table is hampered from being moved in an opening direction.

BRIEF DESCRIPTION OF THE DRAWINGS

FIG. 9(*b*) is a side view showing a state of operating the table lock mechanism according to the embodiment of FIG. 7, showing a state of operating the table to a closing position to pinch a sheets of paper to be bound.

Figure 1:
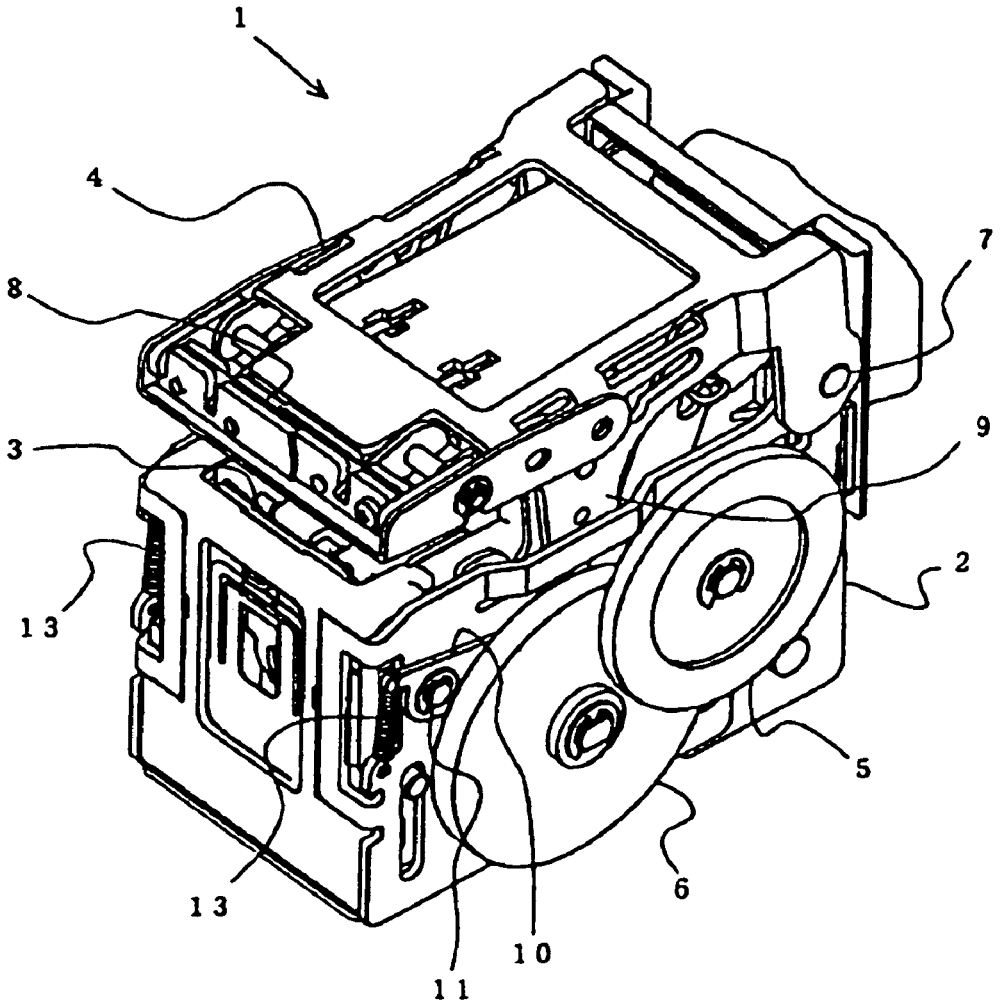
FIG. 1 is a perspective view of an electric stapler embodying a table lock mechanism of the invention.

Further in notations of the drawings, numeral 1 designates an electric stapler, numeral 2 designates a main body frame, numeral 3 designates a staple striking portion, numeral 4 designates a table, numeral 7 designates a support shaft, numeral 8 designates a clincher mechanism, numeral 9 designates a wing piece, notation 9*a* designates a front end edge, numeral 10 designates a lock plate, numeral 11 designates a support shaft, numeral 12 designates a locking pin, numeral 13 designates a spring, numeral 16 designates an eccentric cam, numeral 17 designates a spring cam, numeral 18 designates a guide roller, numeral 19 designates engaging teeth, numeral 20 designates locking teeth, numeral 21 designates a locking piece, numeral 22 designates a spring, numeral 23 designates a rotating cam, numeral 24 designates a cam face, numeral 25 designates a rotating shaft, and numeral 26 designates a motor.

BEST MODE FOR CARRYING OUT THE INVENTION

Figure 2:
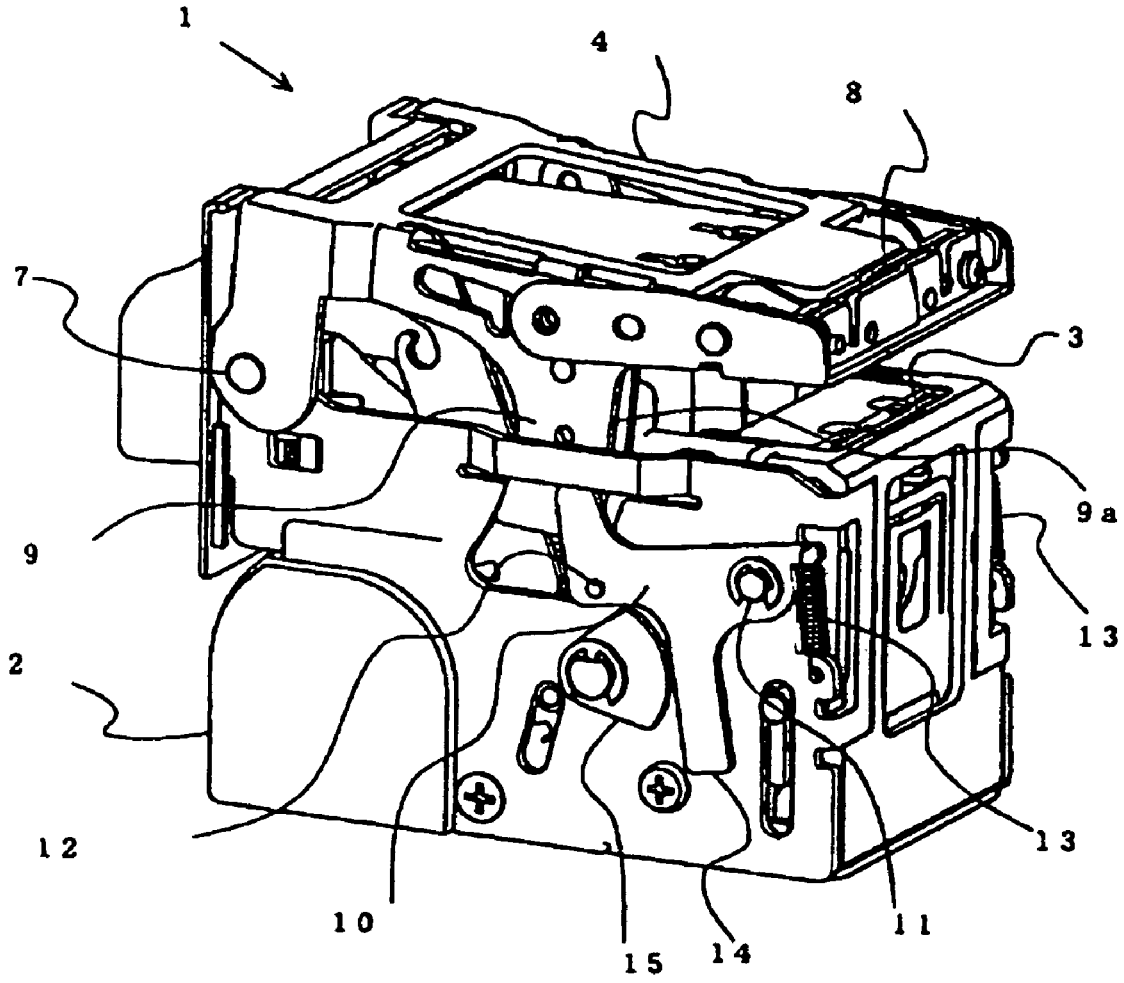
FIG. 2 is a perspective view viewed from a different face of the electric stapler the same as that of FIG. 1.

An explanation will be given of a mode for carrying out the invention based on embodiments shown in the drawings as follows. FIG. 1 and FIG. 2 show an electric stapler embodying a lock mechanism of a table according to the invention. An electric stapler 1 is mounted with a staple cartridge charged with a number of sheet staples in a flat shape at inside of the main body frame 2 arranged at a lower portion of the electric stapler 1. Further, inside of the main body frame 2 is formed with a staple supplying mechanism for successively supplying the sheet staple at inside of the staple cartridge to the staple striking portion 3, a staple forming mechanism for forming the staple in a straight shape supplied to a staple forming portion arranged in just front of the staple striking portion 3 by a forming plate, and a staple striking mechanism for striking out the staple formed in a C-shape and supplied to the staple striking portion to a sheets of paper to be bound by a driver plate.

An upper portion of the main body frame 2 is provided with the table 4 formed with a clincher mechanism for pinching the sheets of paper to be bound arranged at an upper face of the staple striking portion 3 between the clincher mechanism and the staple striking portion 3 and folding to bend a leg portion of the staple struck out from the staple striking portion 3 to penetrate the sheets along a rear face of the sheets by being supported pivotably by the main body frame 2 at a rear end portion thereof. The staple supplying mechanism, the staple forming mechanism, the staple striking mechanism and a motor for driving the staple are provided at inside of the main body frame 2, and a reduction gear 5 and a drive gear 6 for driving the respective mechanisms by the motor are arranged at a side face of the main body frame.

As shown by FIG. 2, the rear end portion of the table 4 is supported by the main body frame 2 pivotably by the support shaft 7, a front portion of the table 4 is formed with the clincher mechanism 8 for folding to bend the leg of the staple penetrated through the sheets of paper to be bound, and the clincher mechanism 8 is arranged to be opposed to an upper face of the staple striking portion 3. The wing pieces 9 projected downwardly from center portions of two side walls of the table 4 along both sides of the main body frame 2 integrally therewith, and the lock plates 10 constituting locking means are arranged at two side faces of the main body frame 2 in correspondence with the wing pieces 9. The lock plate 10 is supported by the main body frame 2 pivotably by the support shaft 11, and an end portion thereof remote from the support shaft 11 is formed with the locking pin 12 to be engaged with the front end edge 9*a* of the wing piece 9 directed frontward.

Figure 3:
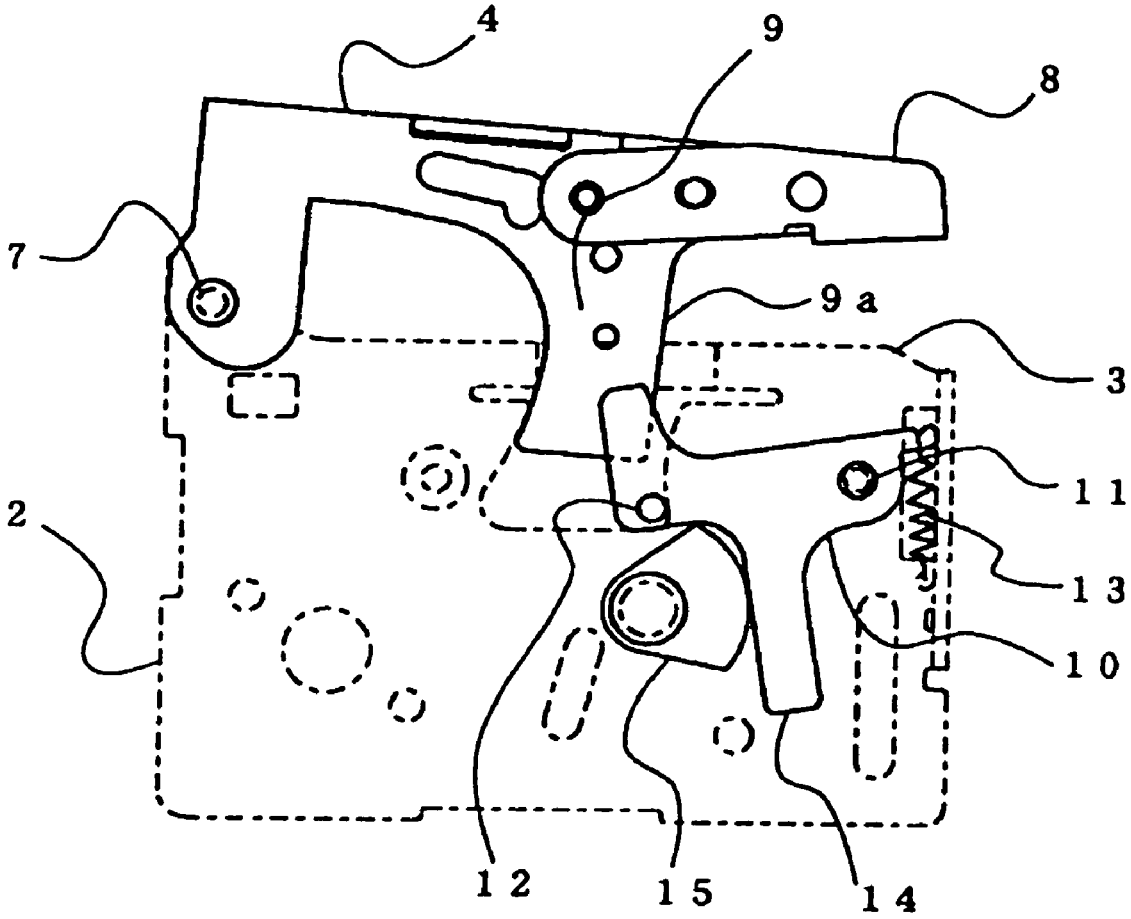
FIG. 3 is a side view showing a table lock mechanism of the electric stapler of FIG. 1.
Figure 4:
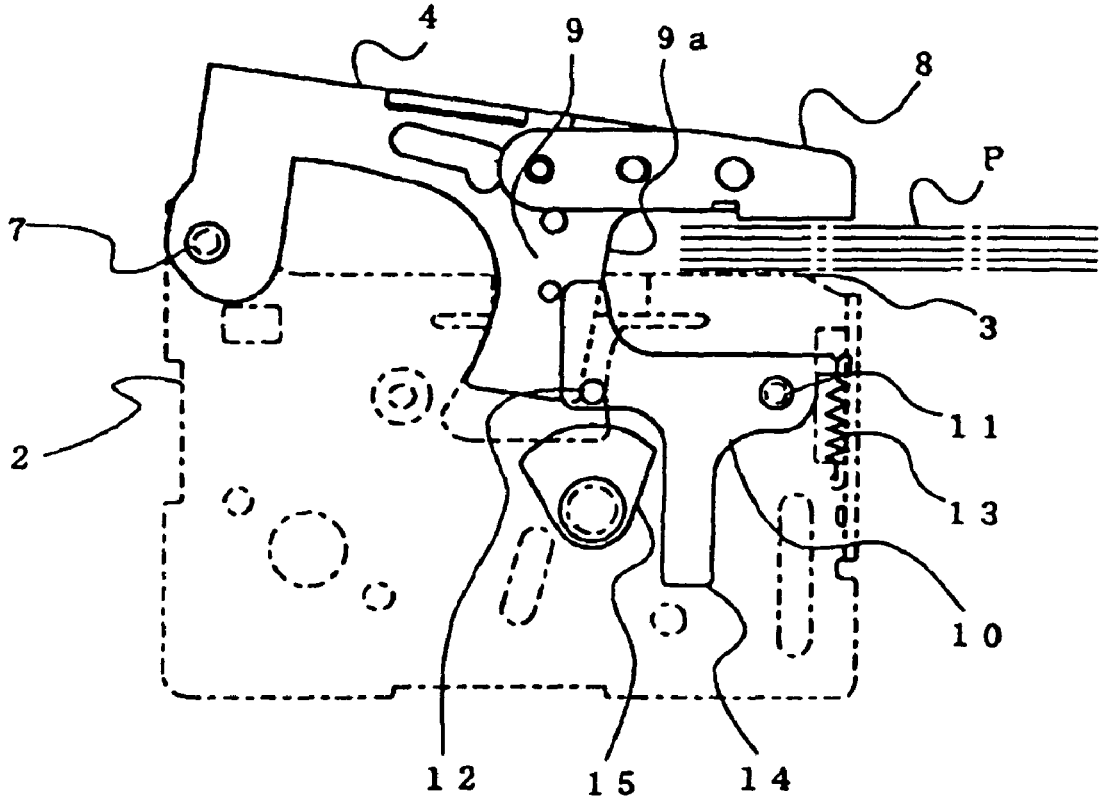
FIG. 4 is a side view of a state of locking a table of the table lock mechanism the same as that of FIG. 3 at a closing position.

As shown by FIG. 3, the lock plate 10 is urged to rotate in the clockwise direction by the spring 13 centering on the support shaft 11, and normally, the locking pin 12 is pivoted to a position separated from the front end edge 9*a* of the wing piece 9 by an operating cam 15 arranged to be brought into contact with an operating piece 14 formed at a lower portion of the lock plate 10 integrally therewith. As shown by FIG. 4, when a sheets of paper P to be bound is mounted on the staple striking portion 3 of the main body frame 2 and the electric stapler 1 is driven, the table 4 is operated to pivot in a closing direction by a drive mechanism, not illustrated, to pinch the sheets of paper P between the staple striking portion 3 and the clincher mechanism 8. Simultaneously therewith, the operating cam 15 operated in cooperation with the drive mechanism is rotated to be separated from the operating piece 14 and therefore, the lock plate 10 is pivoted in the clockwise direction by the spring 13, the locking pin 12 of the lock plate 10 is engaged with the front end edge 9*a* of the wing piece 9. Thereby, the table 4 is locked at a pivoted position of pinching the sheets of paper P between the table 4 and the staple striking portion 3.

When a binding load is operated to a portion of the clincher mechanism 8 of the table 4 to operate a force in an opening direction to the table 4, the locking pin 12 of the lock plate 10 is operated to bite the front end edge 9*a* of the wing piece 9 to hamper the table 4 from being moved to pivot in the opening direction. Therefore, even when the large binding load is produced at the clincher mechanism 8, the table 4 can firmly be locked to a closing position. After finishing to bind the sheets of paper P by the staple, the operating cam 15 is rotated to press the operating piece 14 to pivot the lock plate 10 in the anticlockwise direction to separate the locking pin 12 from the front end edge 9*a* of the wing piece 9 and therefore, the table 4 can be operated to pivot in the opening direction.

Figure 5:
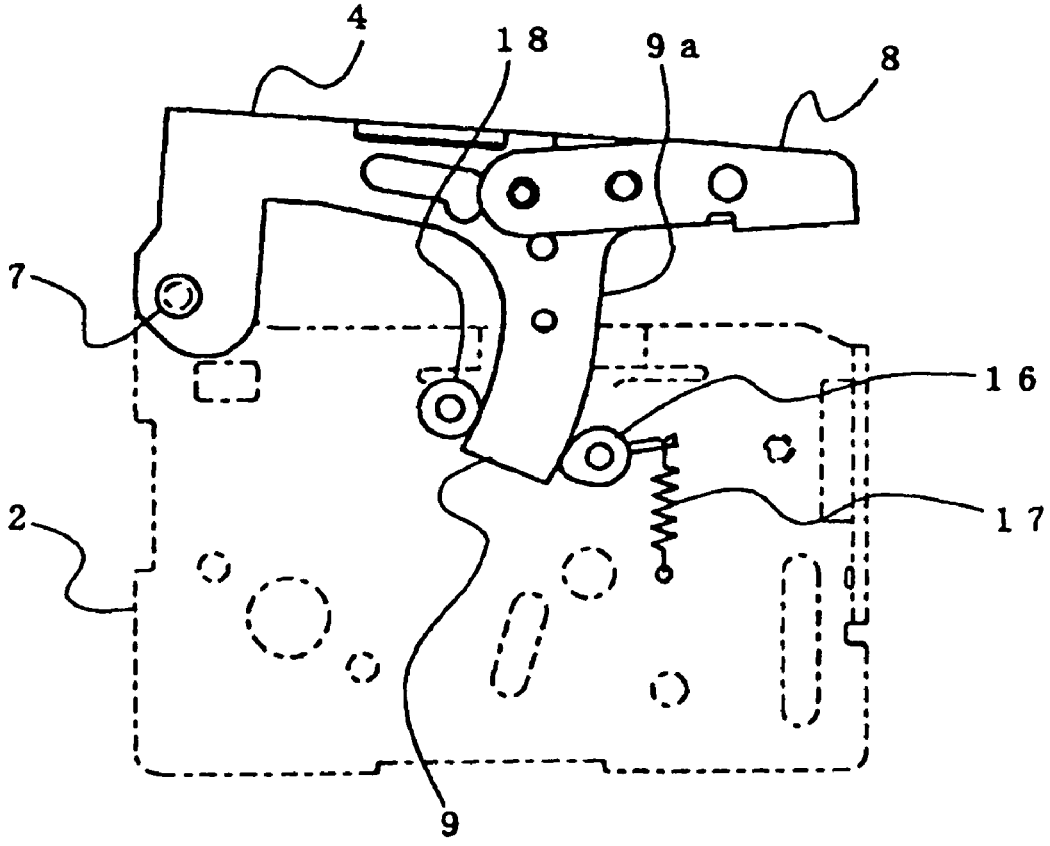
FIG. 5 is a side view showing other embodiment of a table lock mechanism.

FIG. 5 shows other embodiment of a table lock mechanism of the invention, according to the embodiment, the eccentric cams 16 constituting locking means are brought into contact with the end edges 9*a* directed to the front side of the wing pieces 9 formed to project downwardly from the both sides of the table 4, and the table 4 is hampered from being pivoted in the opening direction by engaging the eccentric cams 16 and the front end edges 9*a* of the wing pieces 9. By engaging the eccentric cam 16 exerted with a rotational urge force by the spring 17 with the front end edge 9*a* of the wing piece 9 formed concentrically with the support shaft 7 of the table 4, when the table 4 is pivoted in the opening direction by the binding load, the eccentric cam 16 is operated to bite the front end edge 9*a* of the wing piece 9 to operate to hamper the table 4 from being pivoted. Numeral 18 designates the guide roller for guiding to pivot the wing piece to operate to prevent the wing piece 9 from being deformed by strongly engaging the eccentric cam with the front end edge 9*a* of the wing piece 9 by the guide roller 18.

Figure 6:
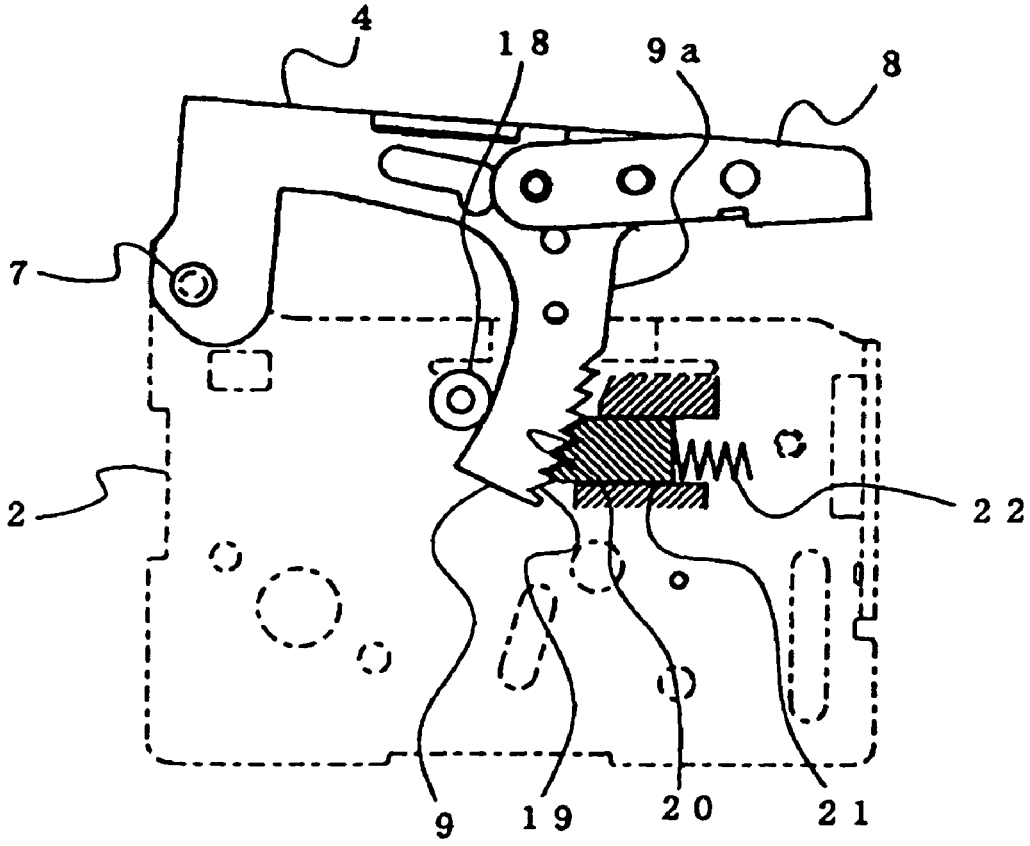
FIG. 6 is a side views showing still other embodiment of a table lock mechanism.

FIG. 6 shows still other embodiment, similar to the embodiment shown in FIG. 5, the end edges 9*a* directed to the front side of the wing pieces 9 formed to direct downwardly from the both sides of the table 4 are formed concentrically with the support shaft 7 of the table 4. Further, locking means according to the embodiment is constituted by the formed fine engaging teeth 19 in a sawtooth-like shape and the locking pieces 21 formed with the locking teeth 20 in a sawtooth-like shape opposed to the front end edges 9*a* of the wing pieces 9 and brought in mesh with the engaging teeth 19 in the sawtooth-like shape at front ends thereof. The engaging teeth 19 formed at the front end edge 9*a* of the wing piece 9 are formed with vertical faces directed to the opening direction of the table and inclined faces directed to the closing direction of the table, and the locking piece 21 is formed with the locking teeth in the sawtooth-like shape brought in mesh with the engaging teeth.

The locking piece 21 is supported to be able to slide in a horizontal direction relative to the main body frame 2, further, the locking teeth 20 of the locking piece 21 are constituted to be urged by the spring 22 in a direction of being brought into contact with the engaging teeth 19 of the wing piece 9. When the table 4 is pivoted in the closing direction to pinch the sheets of paper, the inclined faces of the engaging teeth 19 and the locking teeth 20 are brought into contact with each other and the locking piece 21 is moved to slide in a direction of separating from the wing piece 9 against a press force of the spring 22 to permit to pivot the table 4 in the closing direction, and when the table 4 is exerted with a pivoting force in the opening direction, the vertical faces of the engaging teeth 19 and the locking teeth 20 are engaged with each other to operate to hamper the table 4 from being pivoted. When the staple is finished to be bound, by sliding to move the locking piece 21 in a direction of separating from the wing piece 9 by a release mechanism, not illustrated, engagement of the engaging teeth 19 and the locking teeth 20 is released to enable to pivot the table 4 in the opening direction.

Figure 7:
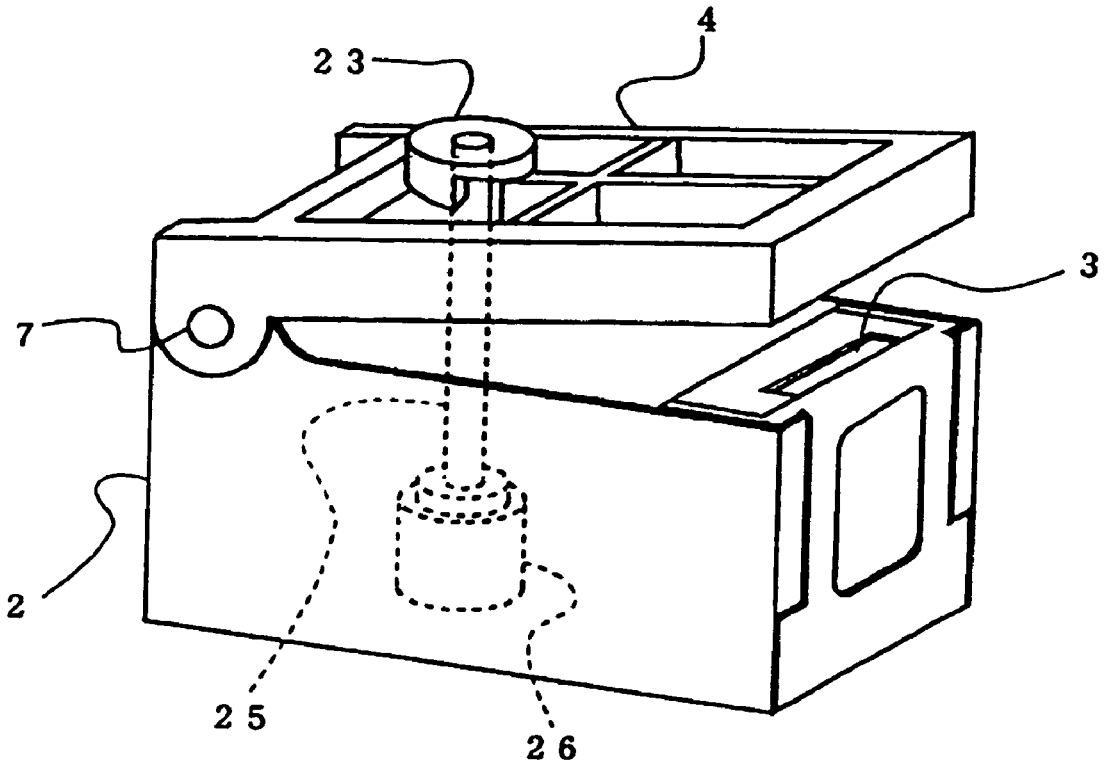
FIG. 7 is a perspective view of an electric stapler embodying still other table lock mechanism.
Figure 8:
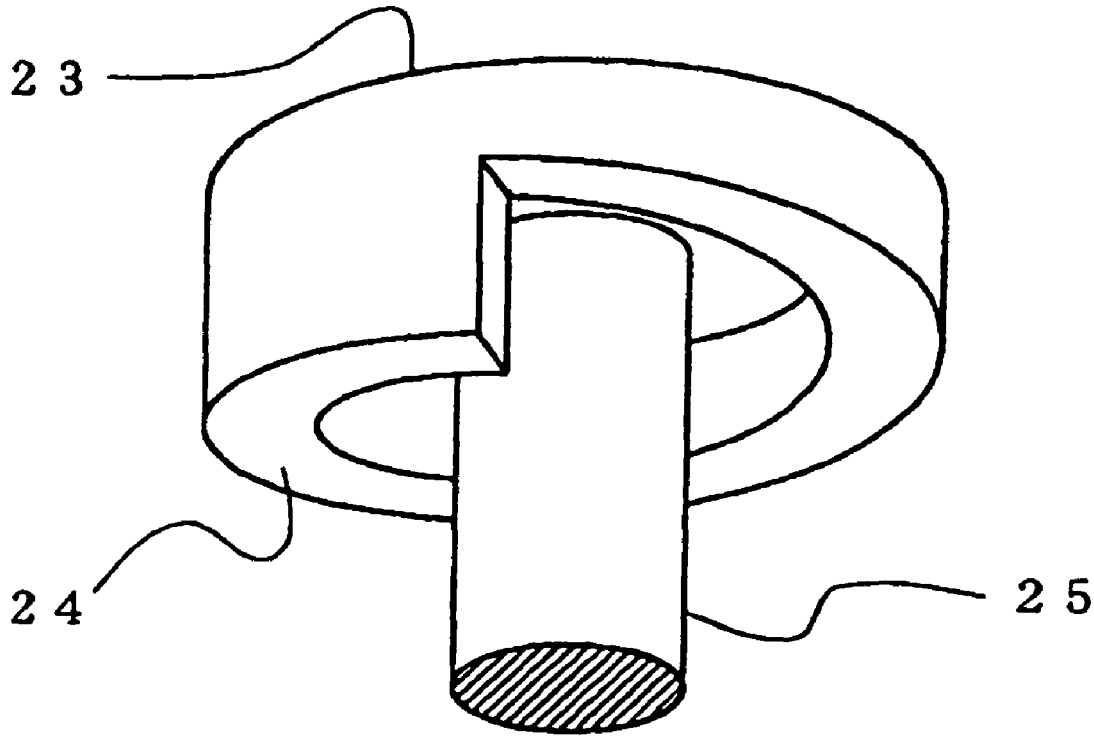
FIG. 8 is a perspective view of a rotating cam according an embodiment of FIG. 7.
Figure 9A:
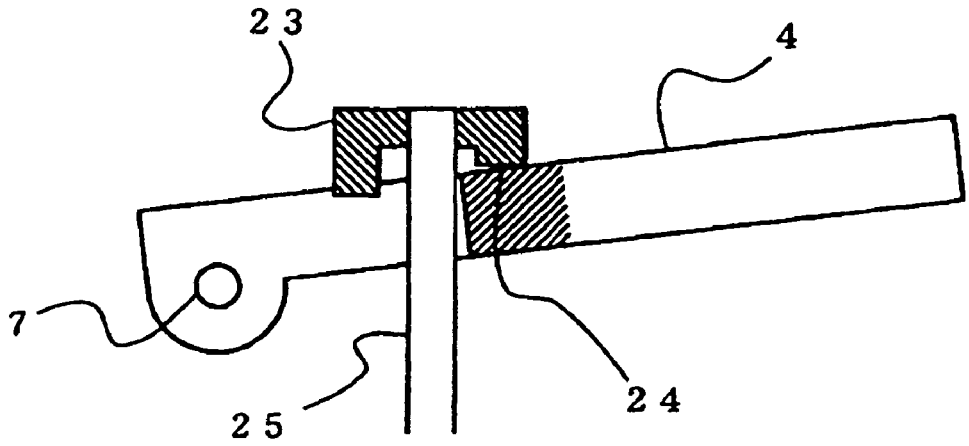
FIG. 9(*a*) is a side view showing a state of operating the table lock mechanism according to the embodiment of FIG. 7, showing a state of arranging the table at an opening position.
Figure 9B:
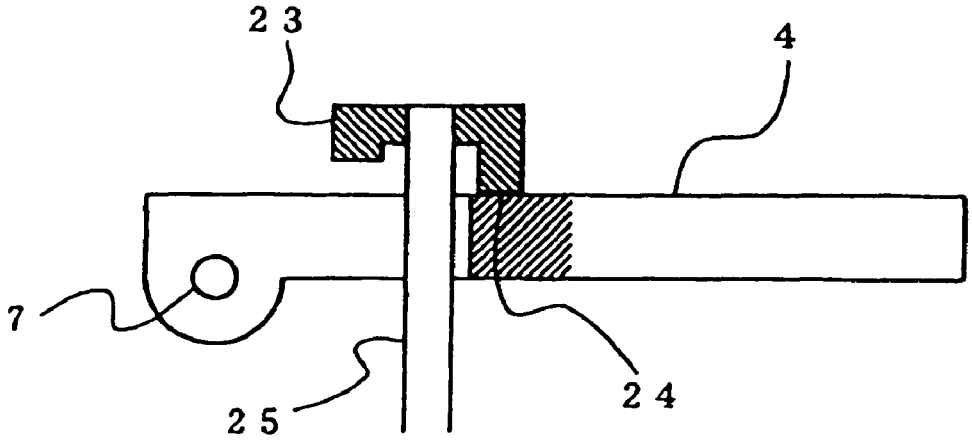
Figure 10:
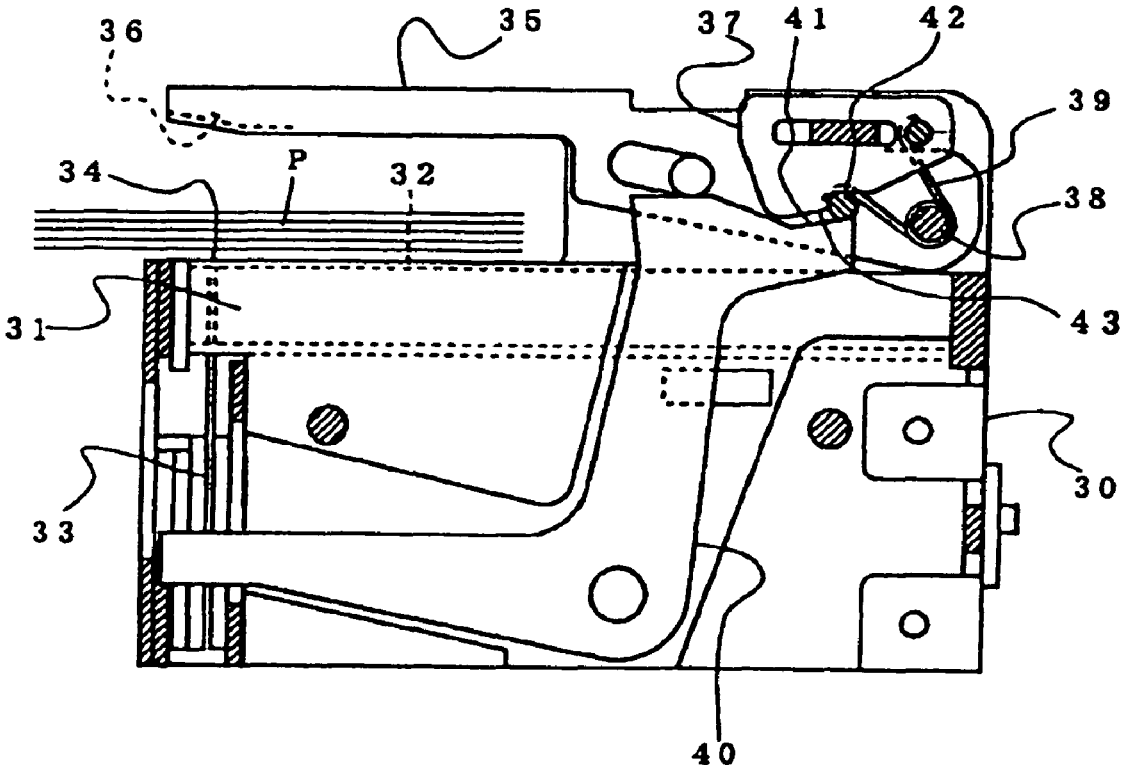
FIG.10 PRIOR ART
FIG. 10 is a vertical side sectional view of an electric stapler embodying a table lock mechanism of a background art.
Figure 11:
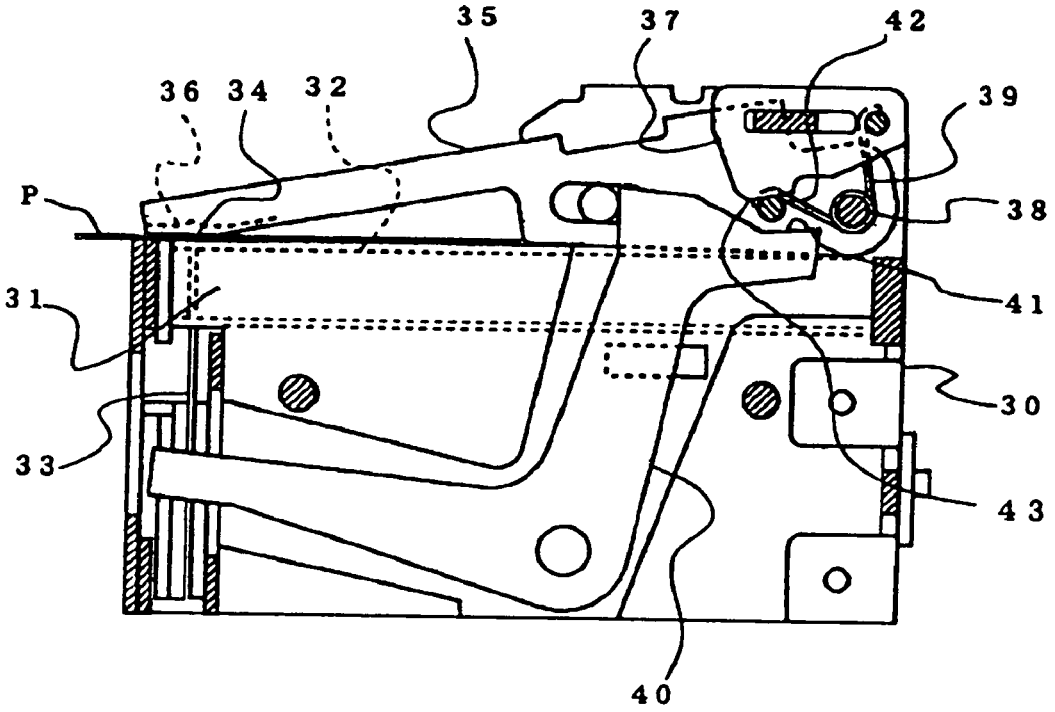
FIG.11 PRIOR ART
FIG. 11 is a vertical side sectional view of a state of locking a table of the electric stapler the same as that of FIG. 10 a closing position.

FIG. 7 through FIG. 9(*b*) show still other embodiment of a table lock mechanism of the invention, according to the embodiment, the rotating cam 23 is arranged at an upper face side of the table 4, the rear end portion of which is pivotably supported by the main body frame 2 by the support shaft 7, and by engaging the cam face 24 formed on a lower face side of the cam with an upper end face of the table 4 by rotating the rotating cam 23, pivotal movement of the table 4 in the opening direction is locked. A front end portion of the rotating shaft 25 rotatably supported by the main body frame 2 is arranged on an upper face side of the table 4 by penetrating the table 4, and the front end portion of the supporting shaft 25 is attached with the rotating cam 23. A lower end portion of the rotating shaft 25 is connected with the motor 26 for driving to rotate the rotating shaft 25, and the rotating cam 23 is rotated in regular and reverse directions by the motor 26 via the rotating shaft 25.

As shown by FIG. 8, a lower face side of the rotating cam 23 is formed with the cam face 24, a height of which is gradually changed in a circumferential direction, and by engaging the cam face 24 with the upper face, the table 4 is operated to be hampered from being pivoted in the opening direction. As shown by FIG. 9(*a*), in a normal state in which the table 4 is arranged at the closing position, a lowest height portion of the rotating cam 23 is opposed to the upper end face of the table 4, and when the rotating cam 23 is driven to rotate by the motor 26 after the table 4 is operated to be pivoted to the closing position of pinching the sheets of paper, as shown by FIG. 9(*b*), the cam face 24 is rotated to the position of being brought into contact with the upper end face of the table 4 to stop, and the cam face 24 achieves to operate as a wedge to hamper the table 4 from being pivoted in the opening direction. When the staple is finished to be bound, by separating the cam face 24 from the upper end face of the table 4 by rotating the rotating cam 23 in the reverse direction by driving the motor 26, the table 4 can be pivoted in the opening direction.

Further, although according to the above-described embodiment, the motor 26 for driving to rotate the rotating cam 23 is formed independently at inside of the main body frame 2, means for driving to rotate the rotating cam 23 is not limited thereto but, for example, the rotating cam 23 may be driven by a motor constituting a drive source of the electric stapler for driving the staple strike out mechanism or the like.

INDUSTRIAL APPLICABILITY

As described above, according to the invention described in Claim 1, the locking means is formed between the wing piece formed at the table and pivoted integrally with the table and the main body frame, the pivoting force in the opening direction of the table is constituted to be hampered by the locking means and therefore, even when a range of varying a thickness of the sheets of paper to be bound is increased, it is not necessary to set a large operating stroke of the locking means, and even when a large binding load is generated, the table can firmly be locked to the closing position.

Further, the locking means is constituted by the lock plate including the locking pin engagable with the front end edge of the wing piece at one end thereof and pivotably supported by the main body frame at other end side remote from the locking pin, when the table is pivoted in the opening direction, the locking pin is engaged with the end edge of the wing piece to hamper the wing piece from being pivoted and therefore, by operating the pivoting force in the opening direction to the table, engagement to the wing piece by the lock plate is operated to strengthen and therefore, small-sized formation of the electric stapler can be achieved without needing a large power of supporting the binding load at the locking means.

Further, the locking means is constituted by the eccentric cam rotatably supported by the main body frame and engageble with the front end edge of the wing piece, the eccentric cam is engaged with the end edge of the wing piece when the table is pivoted in the opening direction to hamper the wing piece from being pivoted and therefore, by operating the pivoting force in the opening direction to the table, engagement to the wing piece by the eccentric cam is operated to strengthen and therefore, small-sized formation of the electric stapler can be achieved without needing a large power to support the binding load at the locking means.

Further, the locking means is constituted by the locking piece formed with the locking teeth engaged with the engaging teeth in the sawtooth-like shape formed at the front end edge of the wing piece, when the table is pivoted in the opening direction, the locking piece is urged in the direction of engaging the locking teeth and the engaging teeth and the wing piece is hampered from being pivoted by engaging the locking teeth of the locking piece with the engaging teeth of the end edge of the wing piece by the locking piece and therefore, even in a large-sized stapler for producing a larger binding load, the table can firmly be locked.

Further, by rotating the rotating cam formed with the cam face the height of which is gradually changed in the circumferential direction by the motor or the like, the rotating cam is engaged with the upper end face of the table to hamper the table from being pivoted in the opening direction and therefore, in contrast to the background art for sliding to move the wedge member, even when the range of varying the thickness of the sheets of paper to be bound is increased, it is not necessary to set a large slide stroke, and small-sized formation of the electric stapler can be achieved.

The invention claimed is:

1. A lock mechanism of a table of an electric stapler comprising:

a table, pivotally supported by a main body frame of the electric stapler, and including a clincher mechanism that pivots to bend a leg portion of the staple penetrated through the sheets along the sheets, and a wing piece formed on each side of the table and extending downward along each side of the main frame body;

locking means formed between each wing piece of the table and the main body frame, wherein a pivoting force in an opening direction of the table is hampered by engaging the locking means with each wing piece of the table;

wherein each locking means comprises a lock plate including a locking pin engageable with the wing piece at one end thereof and supported by the main body frame at other end side thereof, and wherein, by engaging the locking pin with the wing piece to hamper the wing piece from being pivoted, the pivoting force in the opening direction of the table is hampered, wherein the locking means further comprises:

an operating piece formed at the lock plate; and an operating cam arranged to be brought into contact with and to be separated from the operating piece, wherein, when the operating cam is rotated to separate from the operating piece, by rotating the lock plate by a spring, the locking pin is engaged with the wing piece, the wing piece is hampered from being pivoted and the pivoting force in the opening direction of the table is hampered.

2. A lock mechanism of a table of an electric stapler comprising:

a table, pivotally supported by a main body frame of the electric stapler, and including a clincher mechanism that pivots to bend a leg portion of the staple penetrated through the sheets along the sheets, and a wing piece formed on each side of the table and extending downward along each side of the main frame body;

locking means formed between each wing piece of the table and the main body frame, wherein a pivoting force in an opening direction of the table is hampered by engaging the locking means with each wing piece of the table;

wherein the locking means comprises:

engaging teeth in a sawtooth-like shape formed at the wing piece; and a locking piece formed with locking teeth engageable with the engaging teeth, wherein the locking piece is supported by the main body frame slidably in directions to engage and separate from the wing piece, wherein by engaging the locking teeth of the locking piece with the engaging teeth of the wing piece, the wing piece is hampered from being pivoted and the pivoting force in the opening direction of the table is hampered.

* * * * *